US006554008B2

(12) United States Patent
Dewey et al.

(10) Patent No.: US 6,554,008 B2
(45) Date of Patent: Apr. 29, 2003

(54) APPARATUS FOR AND A METHOD OF CLEANING A TRASH BIN

(76) Inventors: Dustin Dewey, 12544 Cross Brook Trail, Jacksonville, FL (US) 32224; Ed Mosley, 2049 Ashland St., Jacksonville, FL (US) 32207

( * ) Notice: Subject to any disclaimer, the term of this patent is extended or adjusted under 35 U.S.C. 154(b) by 47 days.

(21) Appl. No.: 09/751,207

(22) Filed: Dec. 29, 2000

(65) Prior Publication Data

US 2002/0083965 A1 Jul. 4, 2002

(51) Int. Cl.[7] ..... B08B 9/093

(52) U.S. Cl. ..... 134/22.18; 134/145; 134/152; 134/167 R; 134/172

(58) Field of Search ..... 134/22.18, 152, 134/167 R, 168 R, 172, 145, 166 R, 169 R; 422/302, 303

(56) References Cited

U.S. PATENT DOCUMENTS 3,291,144 A 12/1966 Diamond
3,324,866 A * 6/1967 Davis ..... 134/52
3,901,255 A * 8/1975 Pettit
4,242,311 A 12/1980 Middaugh
4,691,723 A 9/1987 Mierswa
4,694,846 A 9/1987 Bouchard
4,907,747 A 3/1990 Kim
5,896,871 A 4/1999 Larsen
5,964,229 A 10/1999 Brendel

* cited by examiner

*Primary Examiner*—Philip Coe
(74) *Attorney, Agent, or Firm*—Jeffrey C. Maynard; Jonathan R. Smith

(57) ABSTRACT

Disclosed are a system and a method for cleaning a trash bin. In a preferred embodiment, the system includes nozzles coupled to lifting means. The nozzles are aimed at the inside of the trash bin. The method includes the steps of lifting the trash bin, inverting it to empty its contents, spraying the inside of the trash bin, and returning the trash bin to the ground. An additional step may include spraying the trash bin when it is returned to the ground.

12 Claims, 9 Drawing Sheets

APPARATUS FOR AND A METHOD OF CLEANING A TRASH BIN

BACKGROUND

The invention relates to a system for cleaning and deodorizing trash bins. The cleaning system could be mounted on a variety of vehicles. In a preferred embodiment, it is mounted on a garbage truck.

Generally, a garbage truck driver cleans a trash bin, if at all, by spraying it manually. A standard garbage truck, equipped with forwardly extending forks, lifts the trash bin from the ground, dumps its contents into the back of the truck, and returns the trash bin to its original position on the ground. The truck is usually equipped with a manual spray nozzle connected by a hose to a pressurized tank containing cleaning fluids. To clean the trash bin, the driver of the truck must either leave the cab, walk to the trash bin and spray inside the trash bin by manually activating the spray nozzle, or pull the truck alongside the trash bin, lift the lid of the trash bin using the forwardly extending forks and spray the trash bin from the cab by aiming and manually activating the nozzle.

This conventional way suffers from various problems. First, this method is extremely inefficient. The driver of the truck must spend a significant amount of time spraying the inside of the trash bins. Second, this method can create environmental and health problems. Frequently, the driver inaccurately aims the spray at the trash bin; thus, causing sprayed chemicals to pollute the ground. Moreover, in manually spraying the trash bin, the driver is often exposed to the cleaning fluids and inhales volatile effluents.

To avoid the problems associated with such conventional procedure, a few cleaning systems have been developed. A common feature among these cleaning systems is the use of spray devices.

For example, one cleaning system uses two pairs of spray nozzles mounted in two different locations on a standard garbage truck. The first pair of nozzles is mounted on the back of the truck and the second pair of nozzles is mounted on the top of the truck cab. Forks on the front of the truck lift a trash bin and invert it to empty its contents into the back of the truck, the driver then activates the first set of nozzles to eject hot water inside the trash bin. Then the forks return the trash bin to the ground. The driver then activates the second set of nozzles to eject deodorizing fluids inside the trash bin.

This cleaning system suffers from various problems. The first set of nozzles, mounted on the back of the truck, is prone to be fouled by contents falling out of the trash bin. The second set of nozzles, mounted on the truck cab, is prone to inaccurate spraying. Because the nozzles are situated far from the trash bin, they are prone to overspray thus creating environmental problems. Additionally, some deodorizing fluids may fall on the windshield of the garbage truck and impair driver vision. Inaccurate spray may also enter the truck cab through air vents or open windows, thus creating health problems. Furthermore, when the trash bin is inverted above the back of the truck, the lid of the trash bin may fall open to a position that blocks the first set of nozzles, defeating a key purpose of the cleaning system.

Another cleaning system employs spray nozzles mounted on a moveable arm mounted in the back of the garbage truck. The arm can be adjusted between two positions. When the trash bin is lifted and inverted, the truck driver positions the arm so that the attached nozzle can spray the content of the trash bin while it falls into the back of the truck. After the trash bin has been emptied, but while the trash bin is still in the air, the truck driver can position the arm to spray inside the trash bin. A serious problem with this system is that the falling and stored garbage may interfere with and damage the arm and nozzle. Additionally, this cleaning system is not capable of spraying the trash bin when it is standing on the ground. Furthermore, the addition of a moveable arm is a costly and complex adaptation.

Another cleaning system features nozzles mounted inside the walls of the back of a garbage truck. It also features a telescoping boom, secured to the side of the truck, with a nozzle at the end. When the forks of the truck lift the trash bin to dump the contents, the wall-mounted nozzles spray the exterior of the bin and the telescoping boom extends inside the bin to spray it. However, nozzle placement and boom operation are conducive to interference by garbage collected in the truck container. Furthermore, the addition of a telescoping boom is an extremely costly and complex adaptation.

Another system employs a spray nozzle mounted on an extendable arm designed to penetrate a spring-closed door on the side of a trash bin. For the system to function, each trash bin has to be modified to include a spring-closed door on the trash bin, a costly and time-consuming undertaking. Moreover, the driver has to precisely maneuver the truck to insert the spray nozzle into the opening of the modified trash bin. Inclined and cracked pavement may make maneuvering the spray nozzle extremely difficult.

Consequently, in light of the problems discussed above, and other problems associated with presently available cleaning systems mounted on garbage trucks, there exists an unfulfilled need for an improved cleaning system capable of spraying a trash bin when it is lifted in the air and when it is standing on the ground. The system must also be able to effectively clean a large number of bins in a short period of time, without dramatically altering the conventional trash dumping process. In addition, the system must clean all sizes of trash bins without a need to modify them. Additionally, the system should be relatively inexpensive and not overly complex. Furthermore, the system should not be conducive to interference or damage by falling garbage, stored debris or open lids.

SUMMARY

An object of the invention is to provide an improved cleaning system able to clean a trash bin when it is lifted in the air and when it is standing on the ground using a single set of nozzles or a plurality of nozzles.

Another object of the invention is to enable a driver of a garbage truck to clean trash bins without having to leave the cab of the garbage truck.

Another object of the invention is to provide for a cleaning system capable of cleaning all sizes of trash bins without a need to modify them.

Another object of the invention is to provide a cleaning system having spray nozzles that are not susceptible to fouling by garbage contents falling into the back of the garbage truck.

An additional object of the invention is to enable a cleaning system that is simple to operate.

Another object of the invention is to provide a cleaning system that does not require extensive adaptation such as the addition of movable arms or booms, or elaborate heating and filtering systems.

Another object of the invention is to provide for a cleaning system, which is not conducive to inaccurate spraying.

A related object of the invention is to provide for a cleaning system that reduces or eliminates driver contact with sprayed chemicals.

Another object of the invention is to provide for a cleaning system capable of handling a large number of trash bins in a short period of time, without dramatically altering the conventional dumping process.

Another object of the invention is to provide for an affordable cleaning system.

Yet another object of the invention is provide for a cleaning system that does not require substantial maintenance.

The above-listed objects are met or exceeded by the present cleaning system. The system for cleaning the trash bin described hereinafter includes a means for spraying the trash bin. The spraying means includes fluid conduits, such as one or more nozzles aimed at the inside of the trash bin. The nozzles may be coupled to a lifting means, which typically includes at least two dumping forks pivotally connected to a first pair of lifting cylinders for providing lifting power to the dumping forks.

The cleaning system further includes a first tank containing a cleaning fluid connected to the spraying means. The cleaning system may also include a second tank containing deodorizing solution fluidly coupled to the spraying means. Alternatively, a single tank may be used for a single fluid or a combined cleaner/deodorizer fluid.

A novel aspect of the cleaning system is the positioning of the nozzles on the lifting means. The nozzles are aimed at the inside of the trash bin preferably from the sides of the trash bin. This enables the nozzles to effectively spray the inside of the trash bin either after the trash bin has been lifted and inverted or when the bin standing on the ground. This placement also enables the nozzles to spray all sizes of trash bins.

"By positioning the nozzles on the lifting means to direct spray from the sides of the trash bin outside the trash bin, the nozzles do not become fouled by the contents falling out of the trash bin, nor is the spray blocked by the position of the trash bin lid when it falls open. Moreover, the position of the nozzles on the lifting means places the nozzles relatively close to the trash bin, which substantially reduces the chances of inaccurate spray and environmental pollution. Additionally, the present invention maintains a safe distance between the spray and the driver."

The cleaning system can be mounted on any vehicle such as a garbage truck. The operator of the vehicle may operate the cleaning system from the cab of the truck. To do so, the operator activates a switch that causes a release valve to open and release cleaning fluid from a tank through hoses to the spraying means. As such, the operator may control the amount of cleaning fluid released and activate the cleaning system without having to leave the vehicle. Alternatively, the cleaning system may be activated automatically without operator involvement. The present invention therefore enables a cleaning system that is simple to operate and does not require substantial maintenance or extensive modifications to the truck.

BRIEF DESCRIPTION OF THE DRAWINGS

These and other features, aspects and advantages of the present invention will become better understood with reference to the following description, appended claims, and accompanying drawings, where:

DETAILED DESCRIPTION OF THE PREFERRED EMBODIMENTS

The invention summarized above and defined by the enumerated claims may be better understood by referring to the following detailed description, which should be read in conjunction with the accompanying drawings. This detailed description of a particular preferred embodiment, set out below to enable one to practice the invention, is not intended to limit the enumerated claims, but to serve as a particular example thereof. Those skilled in the art should appreciate that they can readily use the concepts and specific embodiment disclosed as a basis for modifying or designing other methods and systems for carrying out the same purposes of the present invention. Those skilled in the art should also realize that such equivalent methods and systems do not depart from the spirit and scope of the invention in its broadest form.

Figure 1:
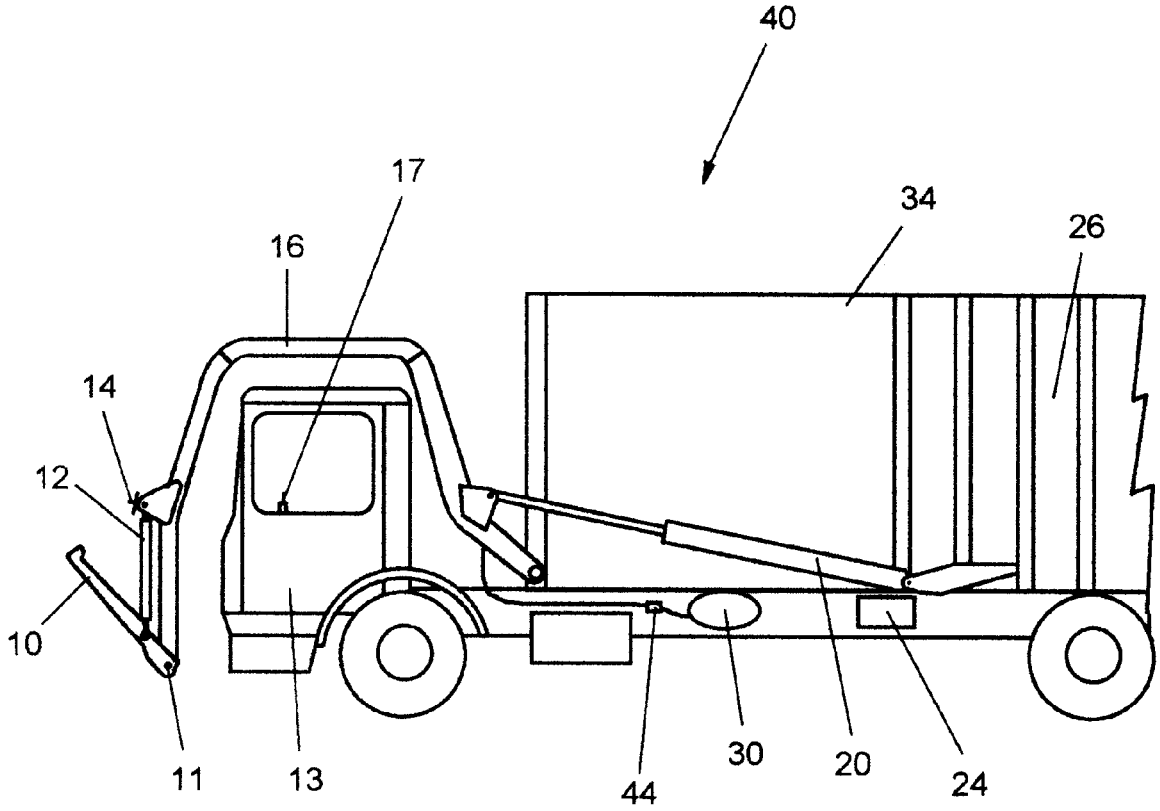
FIG. 1 is a side view of a vehicle for describing an embodiment of the invention.

FIG. 1 shows a side view of a cleaning system of the present invention having nozzles mounted on the lifting means of a vehicle such as a garbage truck 40. The truck 40 is generally comprised of a cab 13 and a body 26 that includes a receptacle 34 into which the contents of a trash bin are dumped.

Figure 5:
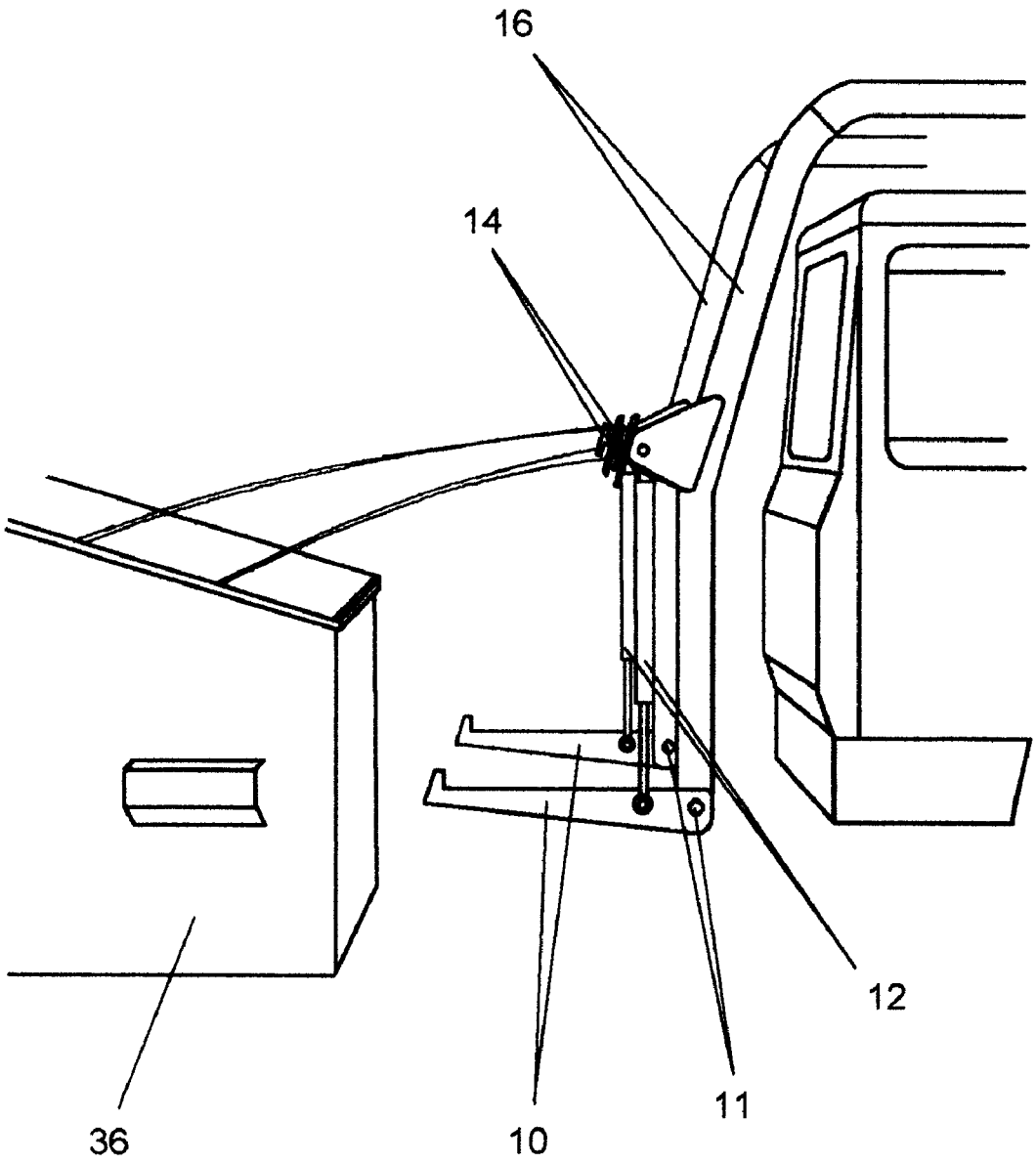
FIG. 5 shows spray nozzles spraying the trash bin on the ground.

A pair of spaced dumping forks 10 are carried at the front of the truck by a cross bar that extends across the front of the truck. The dumping forks 10 are inserted through pick up sleeves of the trash bin, as depicted in FIG. 5, to lift the trash bin.

A first pair of lifting cylinders 12 are carried on a lifting means 16 and pivotally connected to lifting means 16. The first pair of lifting cylinders 12 provides lifting power, hydraulic or pneumatic, to the dumping forks 10, which are pivotally connected to lifting means 16 at joint 11.

The lifting means 16 provides structural support to the first pair of lifting cylinders 12 and the dumping forks 10 and is typically U-shaped. The lifting means 16 is pivotally connected to a second pair of lifting cylinders 20 at its distal end. The cylinders 20 are preferably hydraulic, or pneumatic, or any other types known in the art.

Truck 40 is equipped with conventional hydraulic, or pneumatic, pump controls and reservoirs to allow it to function in its known manner to raise a trash bin, invert it to empty its contents into the receptacle portion 34 of truck 40, and return the trash bin to the ground.

A hydraulic oil tank 24 provides fluids to the second pair of lifting cylinders 20 and the first pair of lifting cylinders 12. The hydraulic oil tank is mounted on the body 26 of the truck.

Figure 2:
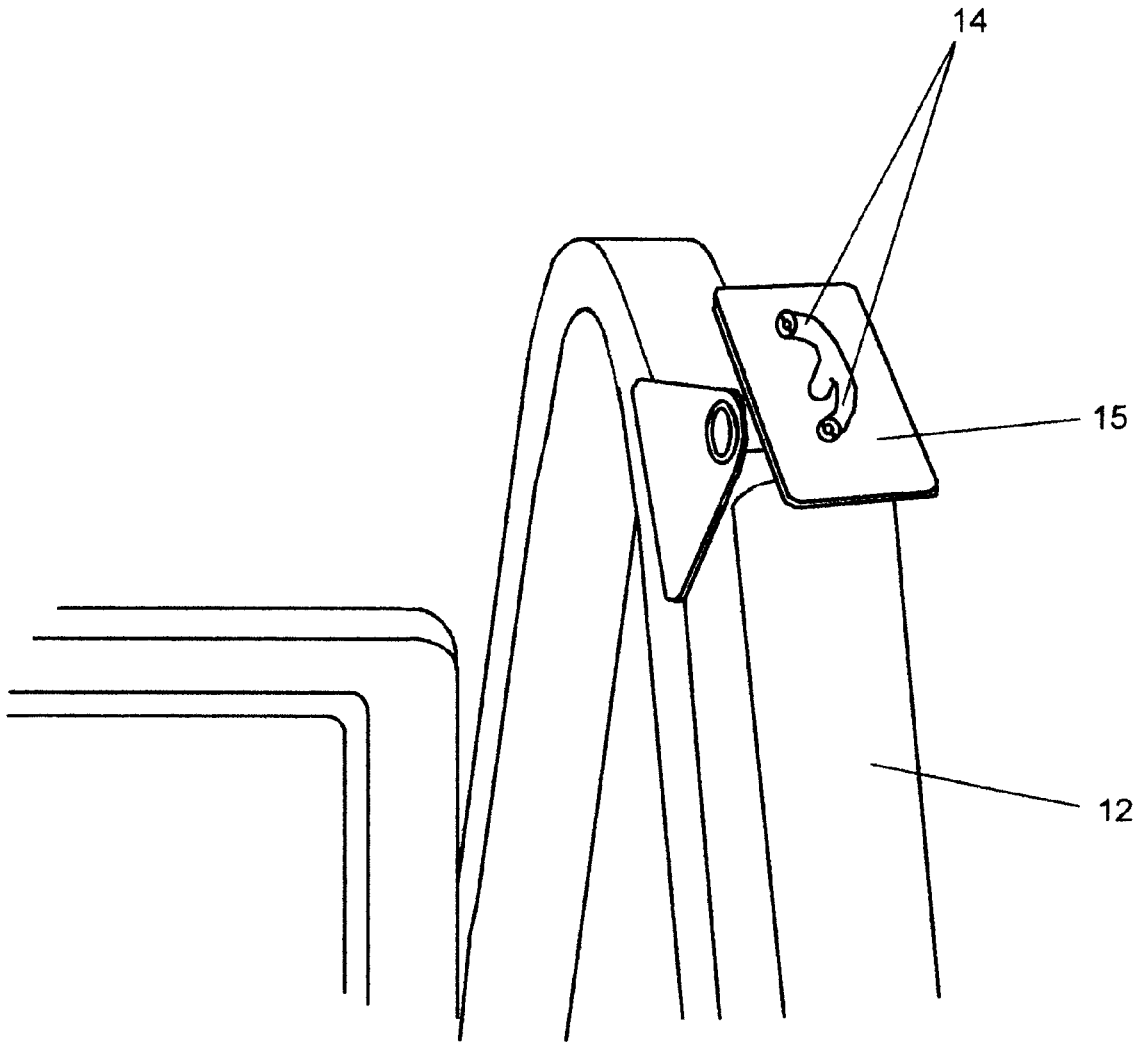
FIG. 2 is a front plan view of a spray nozzle.

Referring to FIG. 2, fluid conduits such as nozzles 14 are coupled to the lifting means 16 (FIG. 1). In a preferred embodiment, nozzles 14 are coupled to a plate 15, which is attached to the lifting means 16 on or adjacent to the first pair of lifting cylinders 12. Alternatively, any other coupling means known in the art can be used to attach the nozzles 14 to the lifting means 16. In another embodiment, the nozzles 14 can also be mounted directly on the first pair of lifting cylinders 12, as described in more detail in the following FIG. 8. Alternatively, nozzles 14 could be mounted on any portion of the lifting means 16, as long as such nozzles 14 are aimed, when spraying, at the inside of a trash bin, whether the trash bin is lifted and inverted above the back of the truck to empty its contents or is standing on the ground. As another alternative, the nozzles may be coupled by integrating them into the lifting means. Additionally, the lifting means may contain fluid carrying conduits or internally mounted hoses for directing fluid to the nozzles.

By mounting the nozzles 14 on the lifting means 16, and aiming the nozzles 14 at the inside of the trash bin, the nozzles 14 are able to spray the inside of the trash bin when the trash bin is raised or when the trash bin is on the ground. The nozzles 14 are also able to spray and clean all sizes of trash bins. Also, because of their positioning, they are able to spray the inside of the trash bin when inverted without any interference from the falling contents.

In a preferred embodiment, at least two nozzles are used. Alternatively, any number of nozzles can be used. For example, a single nozzle may be used to adequately spray the inside of a trash bin. In addition, several nozzles can be aimed at various angles towards the inside of the trash bin.

Figure 3:
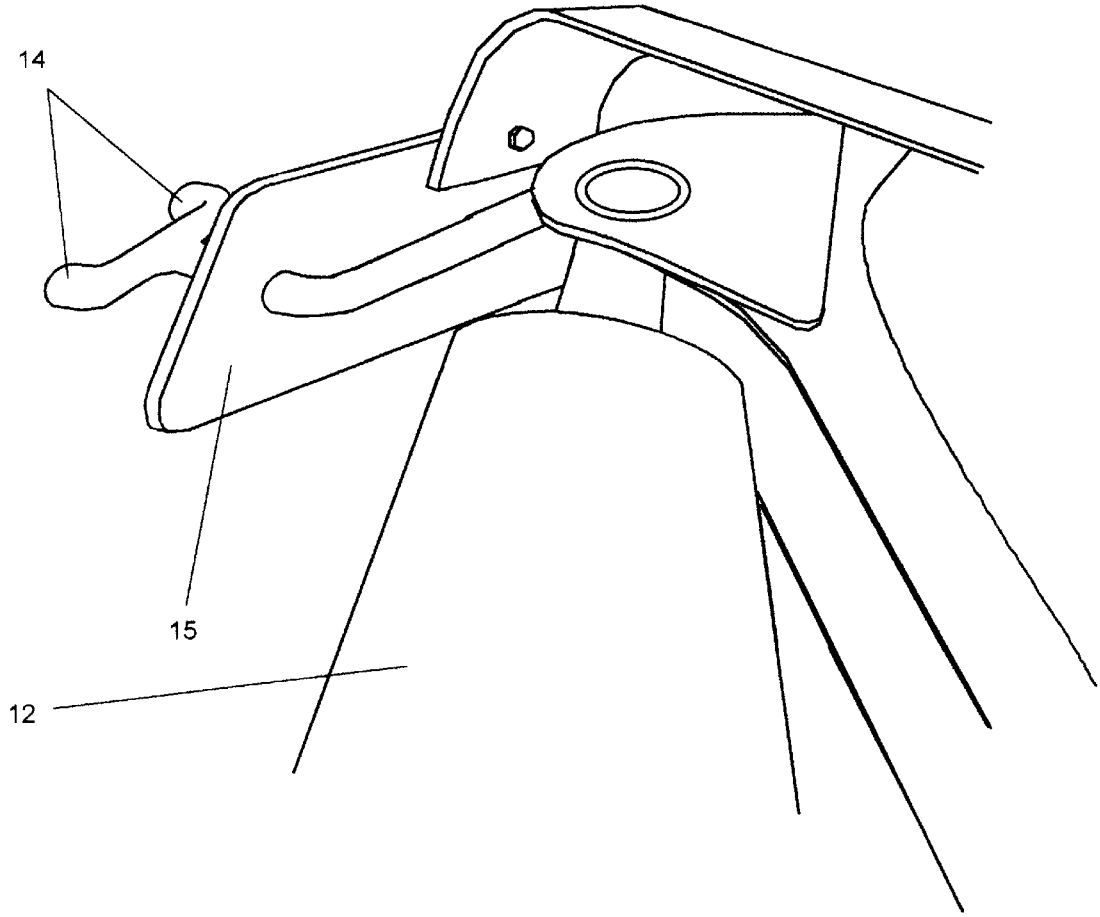
FIG. 3 is a bottom view of spray nozzles.

Referring now to FIG. 3, a bottom view of the spray nozzles 14 is shown. In this embodiment, spray nozzles 14 are mounted on plate 15 on the top of, or adjacent to, the first pair of lifting cylinders 12. The plate 15 facilitates attaching the nozzles 14 to the lifting means 16 (FIG. 1) and aiming the nozzles 14 at the inside of a trash bin. Alternatively, the nozzles 14 could be mounted on any portion of the lifting means 16, including the first pair of lifting cylinders 12, as described in further detail in the following FIG. 8, so long as the nozzles 14 are aimed at and capable of spraying a trash bin when the bin is inverted or when it is on the ground.

Figure 4:
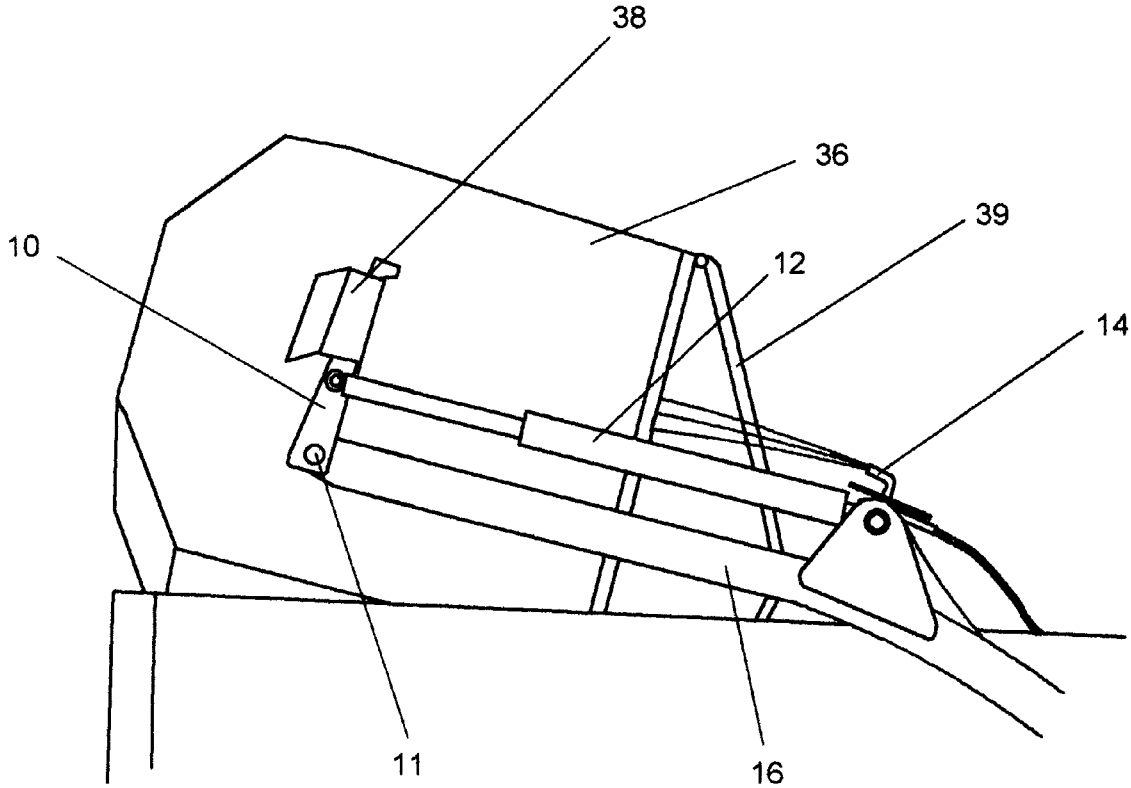
FIG. 4 shows spray nozzles spraying the inside of a trash bin.

FIG. 4 shows the spray nozzles 14 in operation. Once the trash bin 36 is inverted, and after the contents are emptied, the spray nozzles 14, which are aimed at the inside of the trash bin 36, spray cleaning fluids inside the trash bin 36 without any interference from the contents of the trash bin 36.

"The lifting means 16, joint 11, lifting cylinder 12, dumping fork 10 and spray nozzles 14 can be seen in FIG. 4 to lie outside and alongside the trash bin when dumping fork 10 is inserted into pick up sleeve 38 on the trash bin 36. Thus, spray nozzles 14, if installed on any of these pads, will be positioned out from under the trash bin 36 when it is lifted, as shown, and out of the way of trash bin door 39 and falling trash (not visible) during dumping.

FIG. 5 shows the spray nozzles 14 spraying the inside of the trash bin 36 while trash bin 36 is standing on the ground. The spray nozzles 14 are aimed at the inside of the trash bin 36. The unique positioning of the spray nozzles 14 on the lifting means 16 enables the spray nozzles 14 to be aimed at the inside of the trash bin 36 whether trash bin 36 is inverted or on the ground.

The spray nozzles may spray the inside of the trash bin while it is empty, or while it is full to treat the garbage for such purposes as deodorizing or disinfecting.

Figure 6:
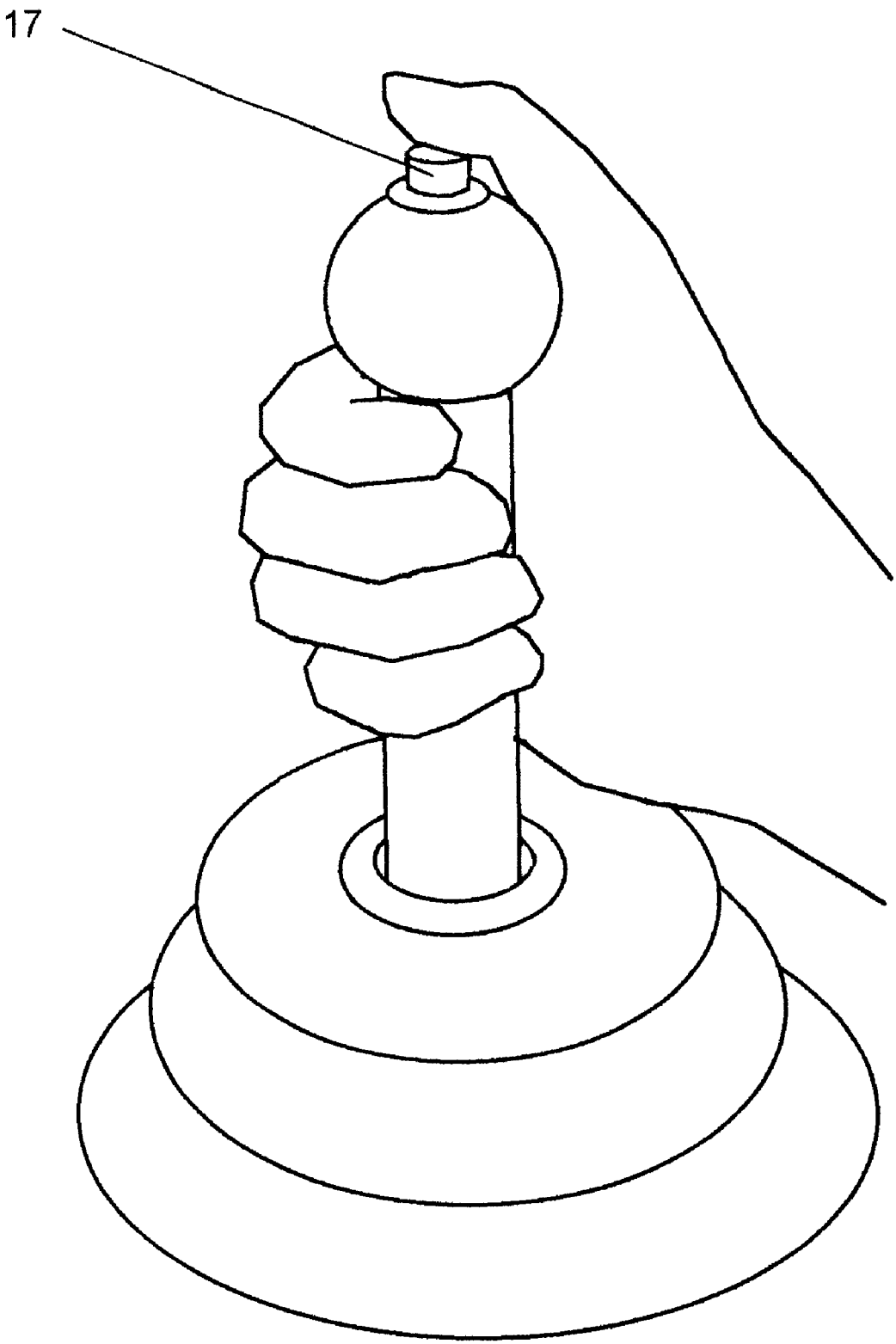
FIG. 6 shows an operating switch for one embodiment of the invention.

As shown in FIG. 6, the truck driver operates the spray nozzles 14 (FIG. 1) from the cab 13 (FIG. 1) by activating a switch 17. The switch 17 may be mounted in the cab 13 in a plurality of fashions. For example, switch 17 may be mounted on a joystick, or on a lever control. When activated, the switch 17 causes the system to release the cleaning fluids from the tank 30 (FIG. 1) to the spray nozzle. The switch preferably accomplishes this by opening a solenoid valve 44, as described in further detail in the following FIG. 8.

In an alternate embodiment, the system may operate automatically. For example, switches or sensors may detect the presence of a trash bin and position of the lifting means. Upon reaching a pre-set position, the lifting means may activate the switch or sensors thereby causing the system to release cleaning fluids.

Figure 7:
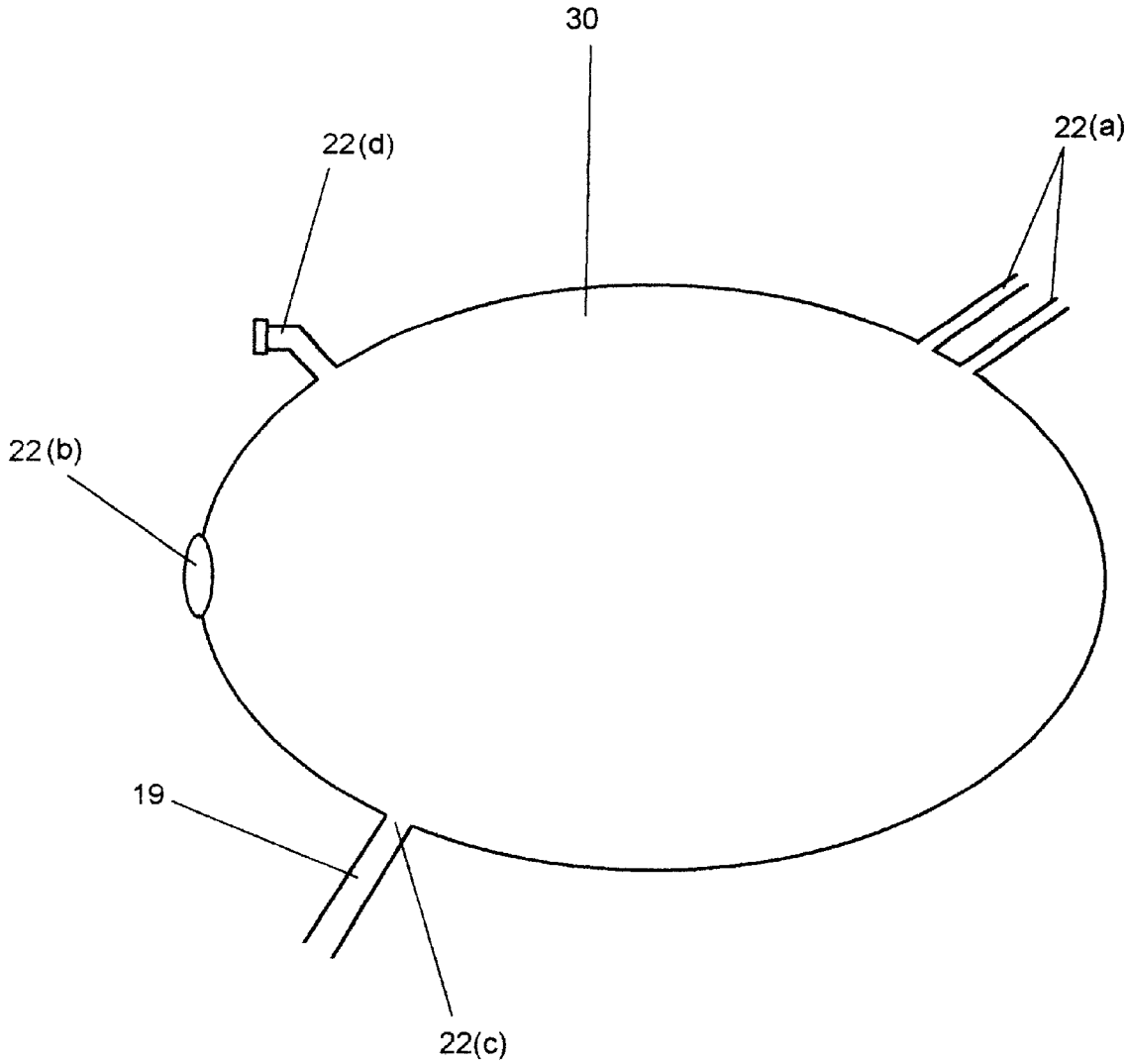
FIG. 7 shows components of a deodorizing or cleaning tank.

In a preferred embodiment of the cleaning system, tank 30, shown in FIG. 7, is pressurized by air from a standard compressor. When the switch 17 (FIG. 6) is pressed, an electric circuit is completed causing valve 44 (FIG. 8) to open. When the valve 44 is opened, the fluid in tank 30 is forced through hose 19 to nozzle 14 (FIG. 1) for spraying the trash bin 36 (FIG. 4). Preferably, valve 44 is a solenoid valve, although other valves capable of being remotely activated could suffice.

In an alternate embodiment, the system may include one or more timing mechanisms to control the time period a switch remains activated or a valve remains opened, thereby governing the amount of fluid sprayed during a cycle.

Alternative embodiments may employ electrical or mechanical pumps, in lieu of or in combination with pressurized air, to force the fluid from the tank to the nozzles.

According to FIG. 7, tank 30 includes means for filling the tank such as a filler neck with a cap 22(*d*), and means for determining the fluid level, such as view level glass eye 22(*b*). Tank 30 also includes means for fluidly connecting to a liquid line for supplying cleaning liquids to valve 44 (FIG. 8) and to nozzles 14 when the valve is opened, such as fluid line 22(*c*). Tank 30 further includes means for fluidly connecting pressurized air lines 22(*a*) to tank 30. Tank 30 may contain cleaner, deodorizer, antifreeze, or other desired fluids, or some combination of the fluids. Tank 30 is connected to the spray nozzles 14 (FIG. 1) through valve 44 and hose 19. When valve 44 is opened, the fluid travels from tank 30 through valve 44 then through the hose 19 to spray nozzle 14. In a preferred embodiment, a single tank is used. However, multiple tanks may be used to increase the cleaning capacity or carry separate fluids such as cleanser and deodorizer.

Figure 8:
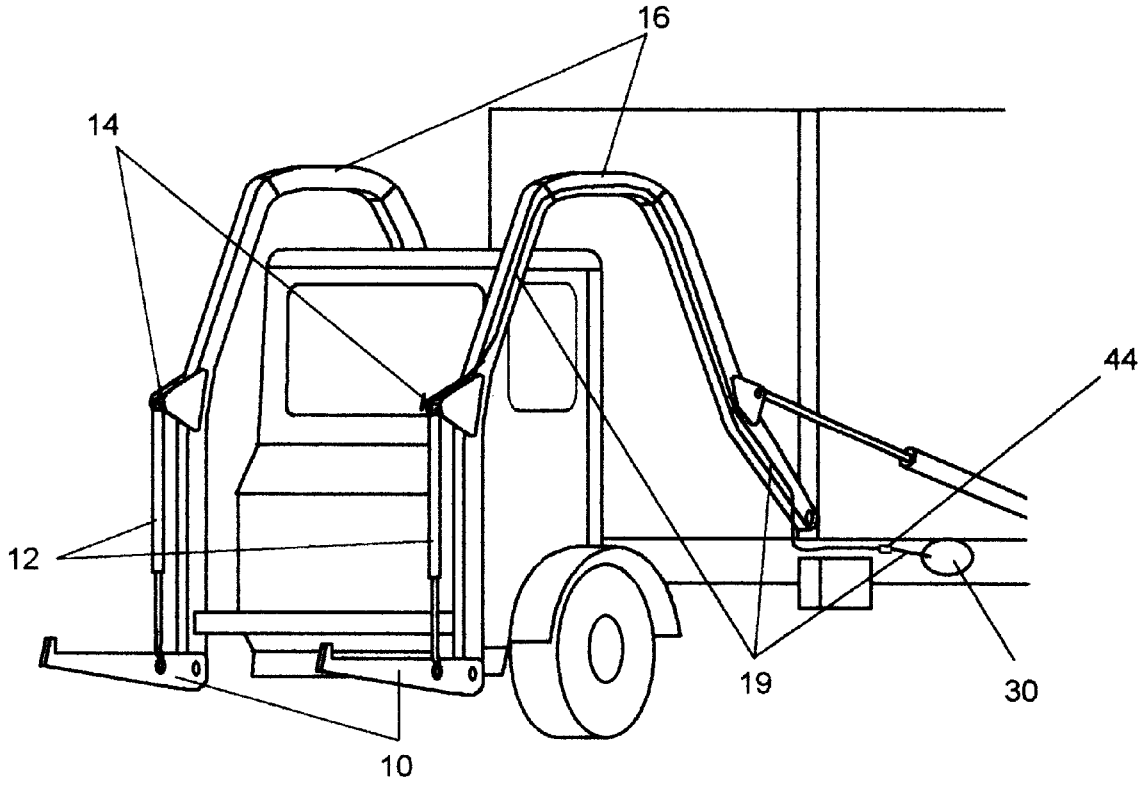
FIG. 8 shows an alternate embodiment of the present invention.

FIG. 8 shows an alternate embodiment. Spray nozzles 14 are mounted directly on lifting means 16. In addition, the hose 19 that carries fluid to spray nozzles 14 may be mounted inside or outside the structure of lifting means 16.

Figure 9:
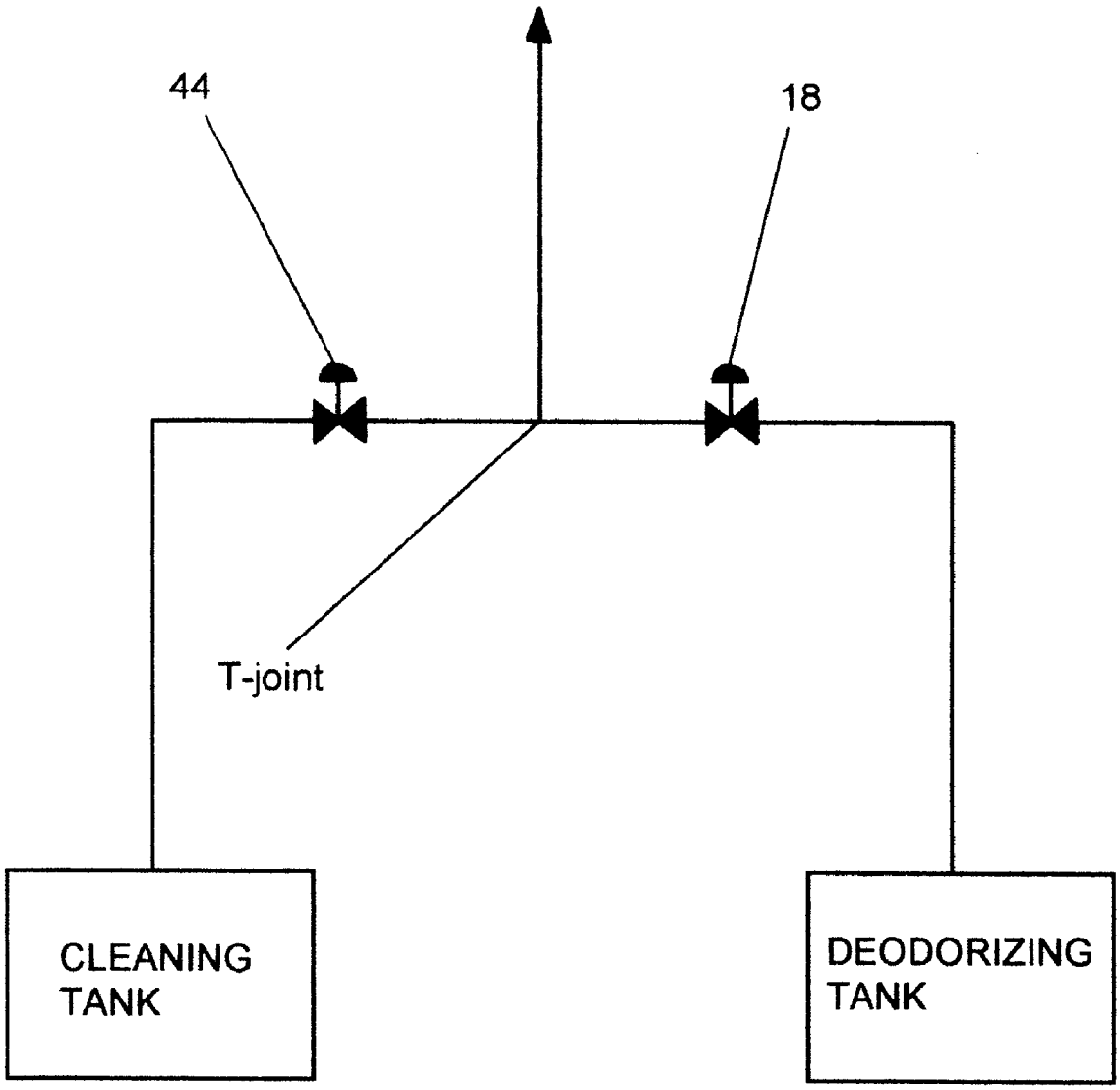
FIG. 9 shows a T-joint valve for describing additional features of the invention.

FIG. 9 shows an alternate embodiment using multiple tanks. These tanks may require a multiple line valve (open line 1, open line 2, close) or valves 44 and 18 connected to a T-joint to separately control the flow from each tank.

Although not specifically shown, it will be understood that while the vehicle used here has been described as a front-loading truck, the invention applies equally well to side or rear loading trash trucks with various means for lifting containers.

While specific values, relationships, materials and steps have been set forth for purposes of describing concepts of the invention, it should be recognized that, in the light of the above teachings, those skilled in the art can modify those specifics without departing from basic concepts and operating principles of the invention taught herein. Therefore, for purposes of determining the scope of patent protection, reference shall be made to the appended claims in combination with the above detailed description.

We claim:

1. A system for cleaning a trash bin to be emptied by a truck having lifting means for lifting the trash bin, the system comprising:

(a) at least one nozzle; and (b) coupling means for coupling the nozzle to the lifting means and aiming the nozzle at the inside of the trash bin, the coupling means being attached to the lifting means at a point on the lifting means that is out from under the trash bin when it is lifted.

2. The system according to claim 1 wherein the coupling means comprises a plate having means for attaching the plate to the lifting means and means for aiming the nozzle at the inside of the trash bin.

3. The system according to claim 1 further comprising a tank, a valve, said valve being interposed between the nozzle and tank and being fluidly coupled to the nozzle and tank, a switch, said switch being functionally coupled to the valve to enable opening the valve, and means for forcing liquid from the tank through the valve and out the nozzle when the valve is opened.

4. The system according to claim 3 wherein the means for forcing liquid from the tank consists of pressurized air introduced into the tank, an electric pump, a mechanical pump, pressurized air introduced into the tank and an electrical pump, or pressurized air introduced into the tank and a mechanical pump.

5. A system for cleaning a trash bin, the system comprising:

(a) means for lifting and emptying the trash bin;

(b) at least one nozzle; and (c) a coupling means for coupling the at least one nozzle to the lifting means and aiming the nozzle at the inside of the trash bin, the coupling means being attached to the lifting means at a point on the lifting means that is out from under the trash bin when it is lifted.

6. The system according to claim 5, wherein the coupling means comprises a plate having means for attaching the at least one nozzle to the lifting means and aiming the at least one nozzle at the inside of the trash bin.

7. The system according to claim 5 further comprising a tank, a valve, said valve being interposed between the nozzle and tank and being fluidly coupled to the nozzle and tank, a switch, said switch being functionally coupled to the valve to enable opening the valve, and means for forcing liquid from the tank through the valve and out the nozzle when the valve is opened.

8. The system according to claim 7 wherein the means for forcing liquid from the tank consists of pressurized air introduced into the tank, an electric pump, a mechanical pump, pressurized air introduced into the tank and an electrical pump, or pressurized air introduced into the tank and a mechanical pump.

9. A method for cleaning a trash bin using a garbage truck and the system according to claim 5, the method comprising the steps of:

(a) Engaging the trash bin with the lifting means; and (b) Spraying liquid inside the trash bin using the at least one nozzle.

10. The method according to claim 9 further comprising the step of emptying the contents of the trash bin into the garbage truck using the lifting means,-wherein said step of spraying liquid inside the trash bin is performed after emptying the trash bin into the garbage truck using the lifting means.

11. The method according to claim 9 further comprising the step of emptying the contents of the trash bin into the garbage truck using the lifting means, wherein the step of spraying liquid inside the trash bin is performed during the emptying of the trash bin.

12. The method according to claim 10 further comprising the steps of returning the trash bin to the ground, spraying liquid inside the trash bin using the at least one nozzle after the trash bin is returned to the ground, and after emptying the trash bin and spraying liquid inside the trash bin.

* * * * *